US005246054A

United States Patent [19]

Shepherd et al.

[11] Patent Number: 5,246,054

[45] Date of Patent: Sep. 21, 1993

[54] ROLL-UP DOOR WITH IMPROVED HANDLE

[76] Inventors: Charles G. Shepherd, 1008 Westdale Road, Oakville, Ontario, Canada, L6L 5A2; D. Bruce Whitehouse, 304 Steeles Avenue East, Milton, Ontario, Canada, L9T 1Y4; Philip W. Davis, 195 Waldoncroft Crescent, Burlington, Ontario, Canada, L7L 3A6

[21] Appl. No.: 866,397

[22] Filed: Apr. 10, 1992

[51] Int. Cl.[5] ..... E06B 9/08

[52] U.S. Cl. ..... 160/133; 160/290.1; 292/DIG. 36

[58] Field of Search ..... 60/133, 201, 290.1; 292/DIG. 36, DIG. 32, 29, 26; 296/98, 100

[56] References Cited

U.S. PATENT DOCUMENTS

| | | | |
|---|---|---|---|
| 3,640,332 | 2/1972 | Luby et al. | 160/133 |
| 3,732,913 | 5/1973 | Wrono | 160/133 |
| 4,294,302 | 10/1981 | Ricke | 160/133 |
| 4,365,660 | 12/1982 | Henkenjohann | 160/133 |
| 4,830,415 | 5/1989 | Nelson | 292/DIG. 36 X |
| 4,870,687 | 2/1989 | Finch et al. | 160/133 |
| 5,022,691 | 6/1991 | Clay | 292/DIG. 36 X |
| 5,078,197 | 1/1992 | Weishar | 160/133 X |

FOREIGN PATENT DOCUMENTS 1449461 9/1976 United Kingdom .

OTHER PUBLICATIONS

Publication: Aluminum Roller Shutters for Commercial Vehicles; Published by Weiland-Werke, not dated.

Publication: NYLOY 30, Published by Dover Roller Shutters, not dated.

Publication: Spring Loaded Lift Bar; Published by Dover Roller Shutters, not dated.

Publication: Lift Bar, Jack Robinson Supplies, not dated.

Publication: Robinson Shutter, Roll-O-Matic, not dated.

*Primary Examiner*—David M. Purol

*Attorney, Agent, or Firm*—Rogers & Scott

[57] ABSTRACT

A roll-up door operable to slide between tracks by using an operating mechanism having a handle which extends substantially the width of the door. When the handle is pushed, it pivots in a housing attached to the door to an actuated position so that a latch at the end of the handle is retracted clear of a slot in one of the tracks. A spring is also provided between the handle and the housing for biasing the handle to pivot to a relaxed position where the latch is engaged in the slot in the track. The operating mechanism also has a lock which can be turned to position a lock bar between the handle and the housing so that the handle cannot be pivoted to the actuated position.

6 Claims, 3 Drawing Sheets

ROLL-UP DOOR WITH IMPROVED HANDLE

This invention relates to roll-up doors and in particular to a roll-up door having an improved operating mechanism including an improved handle and lock.

Roll-up doors are commonly installed on trucks such as fire trucks that are sent out on emergency missions. The doors cover compartments carrying equipment which must be readily accessible at the scene of the emergency and properly protected during transit and storage. For such reasons the operating mechanism must be easy to use, sturdy, lockable and reliable in its operation.

Commonly, a roll-up door has interconnected extruded slats which slide between two vertical tracks installed in parallel at the front side edges of a compartment. At the bottom of the door there is an operating mechanism having a handle which must first be manipulated to release the door and then pushed vertically to open the door. As the door is moved upwardly, the slats roll over an idler at the top of the compartment and then around a spring loaded balancer located between the side walls inside the compartment.

Generally, two types of mechanisms are available to open a roll-up door. The first has a handle which is a localized and central, and which is operated by turning the handle or by pressing a button associated with a fixed handle. This causes rods extending internally to the sides of the compartment to be retracted from keepers to allow the door to be released and raised.

An advantage of a central handle is that it can be locked quite simply by mechanically preventing the handle from turning or by disabling the button. These handles, however, suffer from real disadvantages. For instance, such a handle can be difficult to operate when the user is wearing protective gloves, and the turn handle can also catch on garments during emergency situations.

A second type of mechanism used on roll-up doors has an external handle in the form of a horizontal pivoted bar which extends past the width of the door on both sides. To open the door, the bar is lifted to release it from stops located adjacent and outside the compartment opening. This handle has the advantage that it is easier to grip than the central handle and it can be operated using one or both hands from any position along the width of the door. Furthermore, the natural action of lifting the door handle also opens the door. From a structural standpoint, a well designed bar handle also rigidifies the bottom of the door.

A drawback of the prior art bar handles is that they require a separate lock system that is operated to engage rods into keepers at the sides of the compartment. This adds to cost and maintenance. Often the rods are installed behind the door and connected to the lock at the front of the door. This leaves the possibility that the contents of the compartment, if dislodged, could interfere with the lock and disable it.

Another disadvantage of the second type of mechanism is that the stops are mounted exteriorly with respect to the cabinet complicating the general appearance of the door. If multiple stop locations are desired to hold the door open at various levels, this arrangement becomes awkward. Furthermore if the truck were to accidentially side-swipe a pole, for instance, the mechanism could be damaged allowing the door to open and equipment to fall out.

It is therefore among the objects of the invention to provide a roll-up door with an operating mechanism having a handle presenting an improved grip along the width of the door, the operating mechanism also having a simple integrated lock.

Accordingly, in one of its aspects the invention provides a roll-up door operable to slide between tracks by using an operating mechanism having a handle which extends substantially the width of the door. When the handle is actuated, it pivots in a housing attached to the door to an actuated position so that a latch at the end of the handle is retracted clear of a slot in one or both of the tracks. A spring is also provided between the handle and the housing for biasing the handle to pivot to a relaxed position (i.e. less tensioned) where the latch is engaged in the slot in the track.

In a preferred embodiment the operating mechanism includes a lock which can be turned to position a lock bar between the handle and the housing so that the handle cannot be pivoted to the actuated position.

The invention will be more fully understood with reference to the following description and drawings, of which:

Figure 1:
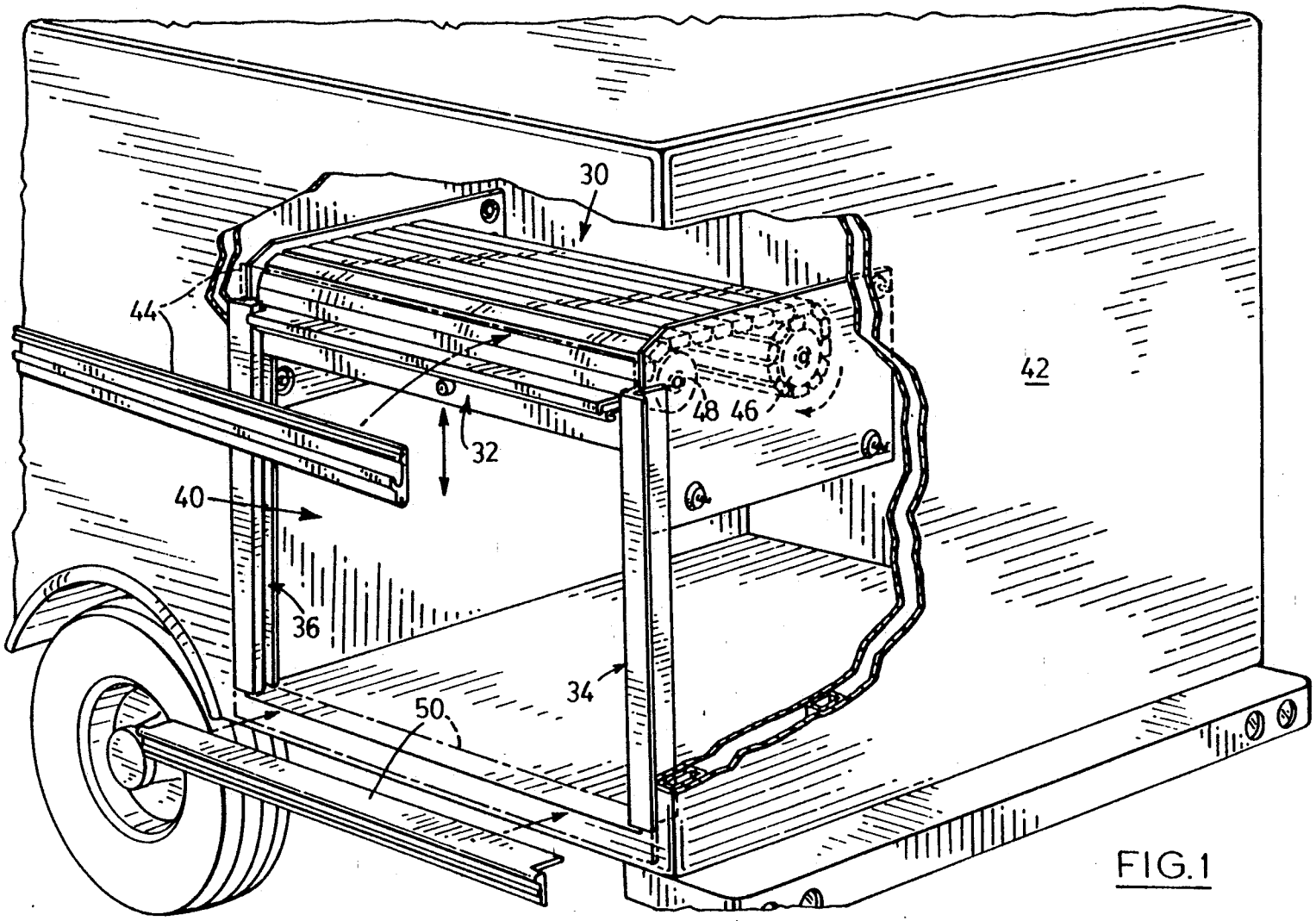
FIG. 1 is a simplified perspective, cut-away and partly exploded view showing a roll-up door and operating mechanism according to a preferred embodiment of the invention and installed in exemplary fashion in a truck.

Reference is made firstly to FIG. 1 which shows an exemplary installation of a roll-up door 30 having an operating mechanism 32 used to slide the door 30 in parallel tracks 34, 36 up or down as indicated by the arrow 38. The tracks 34, 36 are installed at front sides of a side opening compartment 40 in truck 42.

FIG. 1 shows the the compartment 40 open with the door 30 at the top of the tracks 34, 36 and resting against a gutter 44 (shown disassembled). To close the compartment 40 the operating mechanism 32 is pulled downwardly, causing the door 30 to unroll from a balancer 46 over an idler 48, and slide in the tracks 34, 36 to meet a sill 50 (also shown disassembled).

Looking now at FIG. 2, a brief description will be given of how the operating mechanism 32 operates to open and close the compartment 40. A detailed description of how the operating mechanism 32 works will follow with respect to FIGS. 3 and 4.

Figure 2:
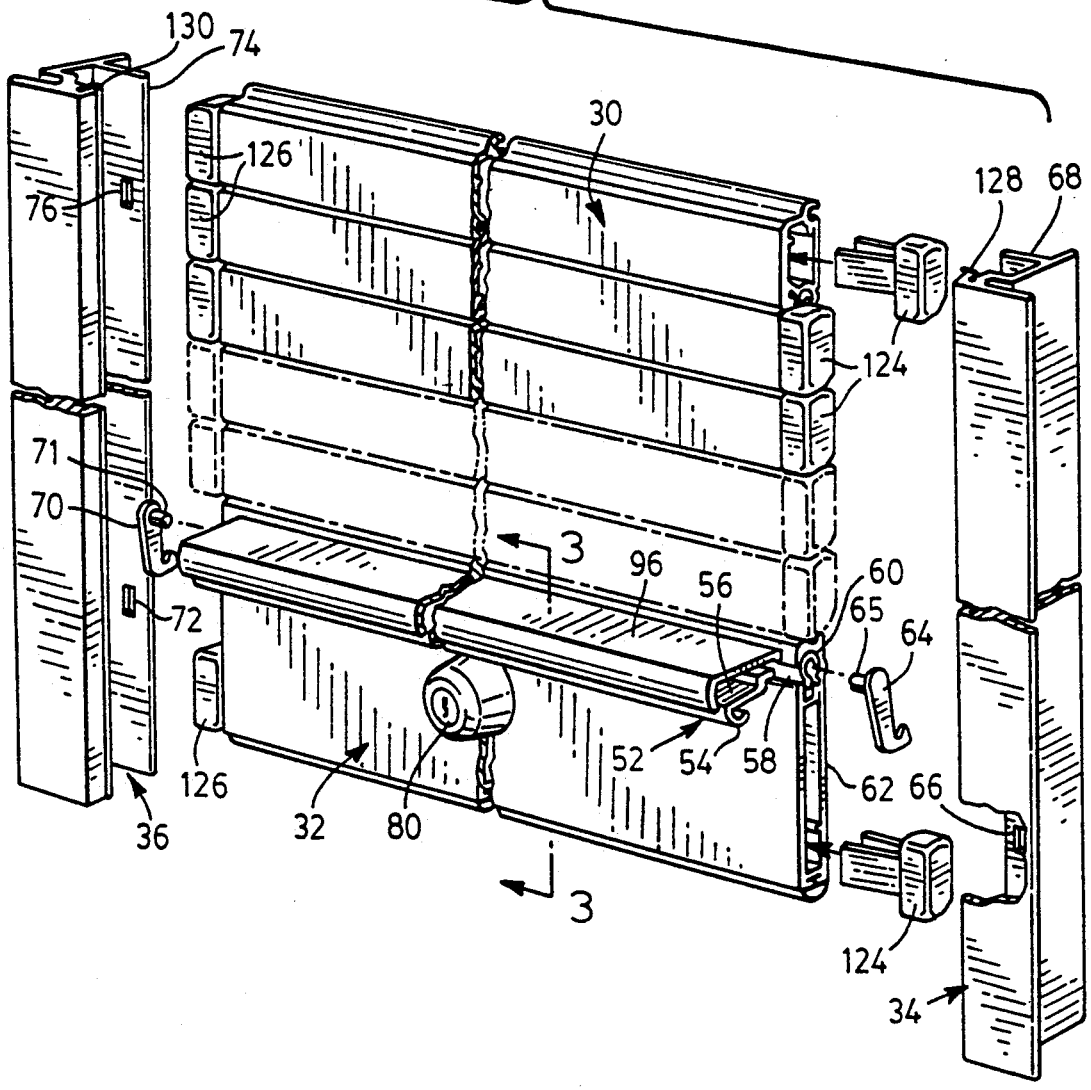
FIG. 2 is a partially exploded, simplified perspective of the roll-up door and operating mechanism showing the relationships between parts of the door and tracks in which the door is slidable.
Figure 3:
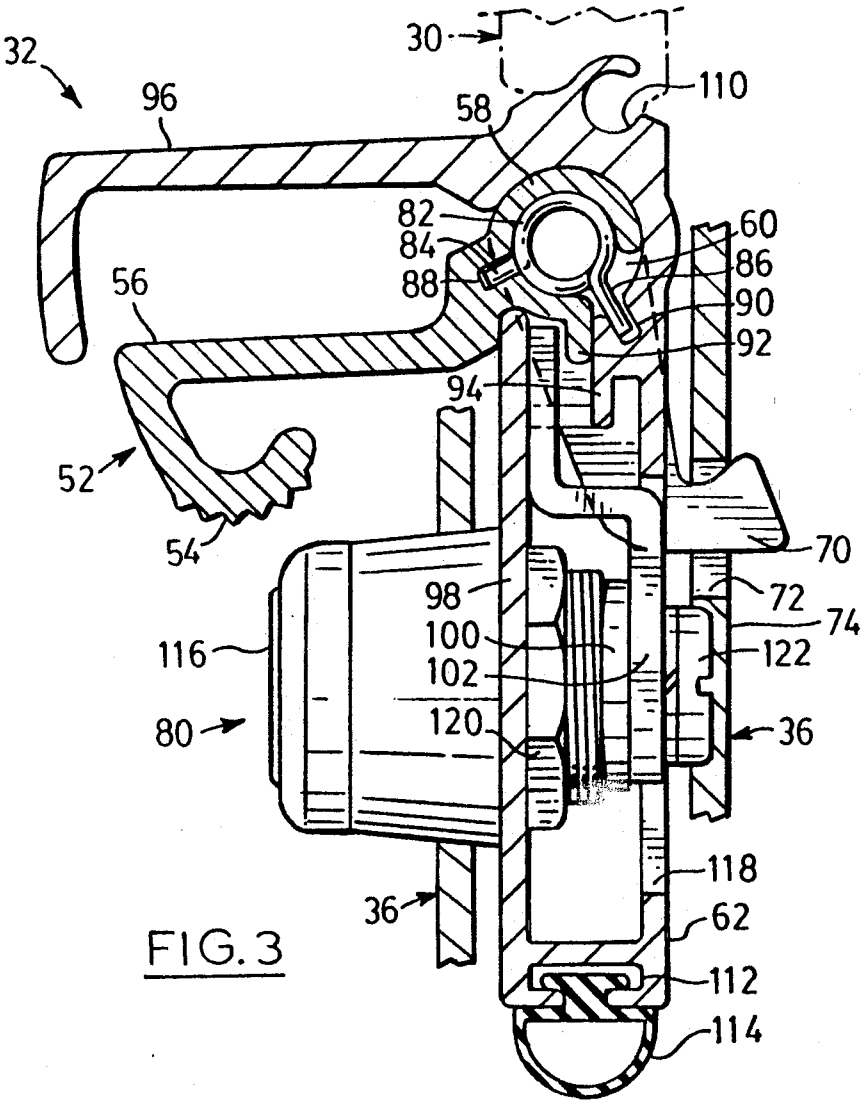
FIG. 3 is a sectional view on line 3—3 of FIG. 2 drawn to a larger scale and showing a handle of the operating mechanism in a relaxed position and a latch of the operating mechanism in an engaged position.

In FIG. 2, it can be seen that the operating mechanism 32, has a handle, represented generally by the numeral 52, and which extends substantially the width of the door 30 (the door is shown with a break so the width of the door is not presented in true proportion). For now it will suffice to note that the handle 52 has a grip 54 which when actuated (in this case lifted) operates arm 56 to transmit a torque to a pivot shaft 58 located in a socket 60 of a housing 62. This action rotates a latch 64 having a keyed boss 65 for engaging in the pivot shaft 58. The boss 65 is a force fit in the pivot shaft 58 and keys in a recess 88 (FIG. 3). The latch is engaged in a slot 66 in an inner wall 68 of the track 34 and retracted by this movement of the grip 54. Once the grip 54 is released, the handle 52 is biased to a relaxed position by a spring (which will be described), so that the latch 64 is rotated into the slot 66. It will become apparent that when the latch 64 engages the slot 66, the door 30 is stopped from sliding in the tracks 34, 36. Conversely, when the latch 64 is retracted clear of the slot 66 the door 30 is free to slide in the tracks 34, 36.

To keep forces balanced, a second latch 70 having a boss 71 is attached to the opposite end of the pivot shaft 58. This latch is rotated in unison with latch 64 to engage or be clear of slot 72 in the inner wall 74 of track 36. A number of slots can be put in the track at desired locations to facilitate setting the door in a variety of positions. An example is slot 76 at the top of the track 36 (a matching slot in track 34 is not shown in the drawings).

The operating mechanism 32 can be locked with lock 80 (as will described) so that the latches 64, 70 cannot be retracted clear of slots 66, 72 respectively or slots 76, 78 respectively. Thus the door 30 can be locked relative to the tracks 34, 36 at any location where slots are provided.

The operating mechanism 30 and lock 80 will now be described in detail with reference to FIGS. 3 and 4. These views are cross-sectional views along line 3—3 in FIG. 2. In FIG. 3, the handle 52 is in the relaxed position where a coil spring 82 biases the handle 52 in a counter-clockwise direction (as drawn) by urging together legs 84 and 86 set in recesses 88 and 90 of the pivot shaft 58 and the housing 62 respectively. This biasing force causes a stop 92 stemming from the pivot shaft 58 to hit a bumper 94 provided by the housing 62. Consequently, the grip 54 of the handle 52 rests in a position removed from a shield 96 and from an outer plate 98 of the housing 62. It is therefore ready to be gripped as will be desribed later with respect to FIG. 4.

To further describe the handle in operation, it can be seen that latch 70 attached to the pivot shaft 58 protrudes through slot 72 in the inside wall 74 of track 36 when the handle 52 is in the relaxed position as drawing in FIG. 3 (Note, latch 64 operates the same way).

The latch 70 can be kept in the slot 72 by the lock 80 which uses a common lock mechanism 100 to turn a lock bar 102 between the stop 92 on the pivot shaft 58 and the outer plate 98 of the housing 62. This effectively prevents the pivot shaft 58 of the handle 52 from pivoting in the socket 60 and therefore the latch 70 cannot be moved out from slot 72. To unlock the door, the mechanism 100 can be turned so that the lock bar 102 is not between the stop 92 and the outer plate 98 of the housing 62 thus permitting the pivot shaft 58 to pivot in the socket 60.

Figure 4:
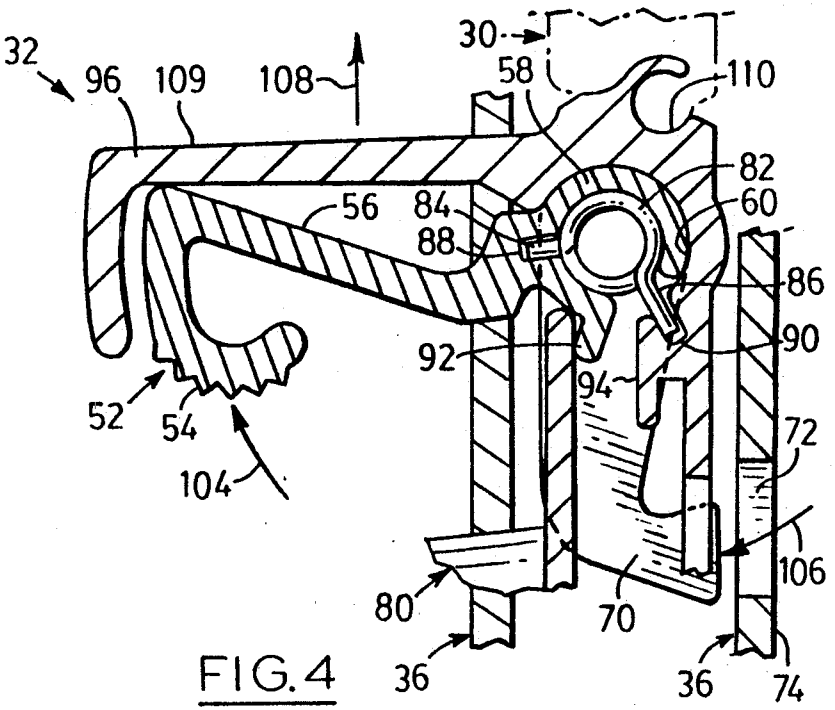
FIG. 4 is a view similar to FIG. 3 and showing the handle of the operating mechanism in an actuated position and the latch of the operating mechanism in a retracted position.

Looking now at FIG. 4, once the door is unlocked, the grip 54 of the handle 52 can be squeezed or lifted against the shield 96 following arrow 104. This transmits torque through the arm 56 to pivot the pivot shaft 58 against the bias of the spring 82 thereby rotating the latch 70 (and 64, not drawn) along arrow 106. The latch 70 is then retracted clear of the slot 72 and is in position in track 36 to permit the door 30 to slide in the tracks 34, 36.

When the latch 70 is retracted clear of the slot 72, the door 30 is free to slide. Since the handle 52 is pivotally mounted for movement angularly in the direction of movement of the door, the action to lift the handle starts to lift the door following arrow 108. This means that the door 30 can be opened in one fluid motion. The operating mechanism 32 may be pulled down using a top surface 109 of the shield 96. Also, if there are multiple slots along the tracks 34, 36, the handle 54 can be actuated by squeezing the grip 54 towards the shield 96 thereby causing the door to bypass the slots. If the handle is not actuated, the door 30 will stop at the slots as the spring 82 biases the latches 64,70 into the slots.

Assembly of the operating mechanism 32 is readily achieved. The housing 62 is preferably an aluminum extrusion extending substantially the width of the door and including the shield 96, the socket 60, the recess 90 and the bumper 94. Also part of this extrusion is a link 110 for pivotally attaching the housing 62 to the rest of the door, and a seal seat 112 for a bottom seal 114 which, when the door is closed, rests against the sill 50 seen in FIG. 1. Likewise the handle 52 is preferably an aluminum extrusion extending substantially the width of the door and including the grip 54, the arm 56, the pivot shaft 58 with the recess 88 and the stop 92. When free of the tracks 34, 36 the handle extrusion simply slides into the socket 60 of the housing extrusion.

The next assembly step is to install the lock 80. Looking at FIG. 3, the lock mechanism 100 is placed through a hole in the outer plate 98 of the housing 62 until a casing 116 with a larger diameter than the hole rests against the outer plate 98. At the back of the housing 62, there is an opening 118 through which the lock mechanism 100 can be accessed. A nut 120 is threaded on the lock mechanism 100 to secure the lock 80 to the housing and the lock bar 102 is attached in a keyed arrangement with a lock screw 122 to the lock mechanism 100. As a result when a key (not shown) is turned in lock 80, the lock bar 102 is turned.

The last step of assembly is to install the latches 64, 70. This can be done with the housing 62 in place on the door 30, attached at joint 110. This results in the configuration of FIG. 2, or it can be done before the housing 62 is joined to the door 30.

To install the latches 64, 70, first the spring 82 is inserted into the pivot shaft 58 so spring legs 84 and 86 rest in recesses 88 and 90. The arrangement is designed with a slight pre-load when spring legs 84, 86 are engaged in the respective recesses 88, 90. Preferably a spring is inserted at each end of the pivot shaft 58. The latches 64,70 are then keyed onto the ends of the pivot shaft 58 by engaging the bosses 65,71. To keep the housing 62 in-line and running smoothly in the tracks 34,36, shoes 124, 126 are inserted at the bottom of the housing 62. The door 30 and operating mechanism handle 32 can then be placed in the tracks 34, 36. It is important to note that track seals 128, 130 and the shield 96 prevent water from entering the housing 62.

The embodiment described shows a truck with a side opening compartment, the invention, of course can be easily installed in a rear opening or top opening compartment and have the same advantages. Although unusual, the door and handle could also be installed to run in horizontal tracks. These and other variations are within the scope of the invention as claimed.

We claim:

1. A roll-up door operable to slide between two tracks defining at least one slot and having an operating mechanism, the operating mechanism comprising:

handle means having a grip extending substantially the width of the door;

a housing connecting the operating mechanism to the roll-up door and including a socket in which the handle means is pivotally mounted for movement angularly in the direction of movement of the door between a relaxed position and an actuated position;

biasing means coupled to the handle means and to the housing to urge the handle means to the relaxed position; and latch means rigidly coupled to at least one end of the handle means and extending past the housing and in alignment with said slot so that when the handle means is in said relaxed position, the latch means is engaged in the slot to stop the roll-up door from sliding in said tracks and when the handle means is in said actuated position the latch means is retracted clear of the slot to allow the roll-up door to slide in said tracks.

2. A roll-up door as claimed in claim 1 wherein the operating mechanism also includes lock means pivotally coupled to the housing and including a lock bar for positioning between the handle means and the housing so the handle means cannot be pivoted to said actuated position.

3. A roll-up door as claimed in claim 1 wherein there are a plurality of slots located along at least one of said tracks so that when the door is operated to slide between said tracks, the latch means engage at least one of the slots thus causing the door to be located in the track means.

4. A roll-up door as claimed in claim 1 wherein the handle means and the housing are extrusions adapted to slide into one another at said socket.

5. A roll-up door as claimed in claim 4 wherein the housing extrusion also includes a shield extending substantially the width of the door to protect the operating mechanism and to provide a surface with which to squeeze the handle means to the actuated position.

6. A truck compartment that can be opened or closed by a roll-up door having pivotally interconnected extruded slats operable to slide in tracks defining at least one slot and mounted at front sides of the compartment, the door including a housing pivotally attached to an exposed one of said slats and providing a socket parallel to said slats, a handle positioned to pivot in said socket and having a grip extending substantially the width of the door to receive a pushing force for pivoting the handle in said socket from a relaxed position to an actuated position, at least one latch attached to an end of the handle and in line to retract clear of said slot allowing the door to slide in the tracks, and at least one spring between the handle and the housing to bias the handle to pivot to said relaxed position where the latch engages said slot thereby stopping the door from sliding in the tracks.

* * * * *